United States Patent [19]

Forsell

[11] Patent Number: 4,458,225

[45] Date of Patent: Jul. 3, 1984

[54] CIRCUIT BREAKER WITH INDEPENDENT MAGNETIC AND THERMAL RESPONSIVE CONTACT SEPARATION MEANS

[75] Inventor: Kenneth A. Forsell, Whitefish Bay, Wis.

[73] Assignee: Eaton Corporation, Cleveland, Ohio

[21] Appl. No.: 442,707

[22] Filed: Nov. 18, 1982

[51] Int. Cl.[3] ..... H01H 73/02; H01H 73/18

[52] U.S. Cl. ..... 335/35; 200/151; 335/23

[58] Field of Search ..... 335/14, 23, 35; 200/151

[56] References Cited

U.S. PATENT DOCUMENTS

| | | | |
|---|---|---|---|
| 1,629,640 | 5/1927 | Schactner | 200/151 |
| 2,153,396 | 4/1939 | Sambleson | 200/151 |
| 2,254,347 | 9/1941 | Blakesley | 200/165 |
| 2,321,603 | 6/1943 | Jensen | 335/14 |
| 2,477,837 | 8/1949 | Strom | 200/150 |
| 3,311,725 | 3/1967 | Butler et al. | 337/343 |
| 3,842,228 | 10/1974 | Green | 200/151 |

*Primary Examiner*—J. D. Miller
*Assistant Examiner*—George Andrews
*Attorney, Agent, or Firm*—C. H. Grace; L. G. Vande Zande

[57] ABSTRACT

A molded case circuit breaker having a movable contact arm (12) pivotally supported on a operating handle (4) and driven into and out of engagement with a stationary contact (6) by an overcenter toggle spring (28) stretched between the movable contact arm (**12*a*) and a latch lever (14) which is releasable to carry the line of action of the spring (28) overcenter of the movable contact arm (12) to cause automatic separation of the contacts (6,10) in response to operation of a bimetal thermal overload sensing unit (18) and which has a separate magnetic overload current sensing unit (38,40) disposed on the stationary contact support (8) and isolated from the thermal overload current sensing unit (18), the magnetic sensing unit (8) operating to release an insulating wedge member (44) for movement between the circuit breaker contacts (6,10**) to separate the contacts independently of the latch trip operating mechanism.

11 Claims, 2 Drawing Figures

CIRCUIT BREAKER WITH INDEPENDENT MAGNETIC AND THERMAL RESPONSIVE CONTACT SEPARATION MEANS

BACKGROUND OF THE INVENTION

This invention relates to circuit breakers of the molded case, narrow width type such as is shown and described in U.S. Pat. No. 3,081,386 to M. F. Koenig, et al, dated Mar. 12, 1963 and owned by mesne assignments by the assignee herein. Circuit breakers of this type are normally utilized in residential and commercial applications up to 240 volts.

Circuit breakers of the above type commonly employ spring loaded latch trip mechanisms which are manually operable to selectively open and close the circuit breaker contacts and which are automatically operable in response to overload current conditions to separate the contacts. Automatic operation occurs when a magnetic or thermal responsive sensor operates to unlatch the mechanism in response to overload currents. In the interest of effective space utilization the magnetic and thermal responsive sensors are commonly interrelated. For example, the thermal sensor may be a bimetal member which also serves as a single turn winding for an electromagnetic core of the magnetic sensor. The latter has a movable armature associated therewith which in turn has a latch trip catch member for releasing the spring loaded latch trip operating mechanism upon attraction of the armature to the core. A lost motion mechanical connection between the bimetal and the movable armature permits the bimetal member to operate independently of the magnetic sensor to trip the latched operating mechanism. Small overload currents are detected by the bimetal thermal sensor, causing it to deflect and pull the armature to a latch releasing position. Higher fault current conditions are detected by the magnetic sensor wherein the current passing through the bimetal member generates an electromagnetic field within the core to attract the armature and release the latch before the bimetal warps to its deflected position due to the same overload currents. Thus the magnetic sensor responds more quickly to higher overload current conditions than does the thermal sensing bimetal, but each operate to separate the contacts by unlatching the operating mechanism to cause it to move to a tripped position and thereby open the contacts.

The amount of current being made available by electrical utilities to the residential or commercial customer is increasing in newer installations. Accordingly, the short circuit currents available in these newer installations increases significantly and the interrupting capability of circuit breakers must also increase. One method of increasing the interrupting capability of an electric circuit breaker is to increase the speed with which the circuit breaker operates to separate the contacts in response to fault current conditions. Circuit breakers which employ the spring loaded operating mechanism in conjunction with a releasable latch mechanism for the magnetic trip function are limited in their contact separation speed because the operating mechanism moves sequentially after release of the latch by the magnetic sensor to cause the mechanism to toggle the contacts open.

SUMMARY OF THE INVENTION

The invention herein disclosed provides a single pole, thermal and magnetic trip circuit breaker of the narrow width, molded case type having a spring loaded over center operating mechanism for manual operation of the circuit breaker contacts between open and closed positions, a thermal sensor operable to release the latched operating mechanism in response to small overload currents to cause separation of the circuit breaker contacts, a magnetic sensor separate and isolated from the thermal sensor, and means for separating the circuit breaker contacts independently of the operating mechanism, such means being directly actuated by the magnetic sensor. The magnetic sensor is located adjacent the "ON" side terminal of the circuit breaker while the thermal sensor is located adjacent the "OFF" side terminal of the circuit breaker. The features and advantages of this invention will become more apparent in the following description and claims when read in conjunction with the accompanying drawings.

DESCRIPTION OF THE PREFERRED EMBODIMENT

Figure 1:
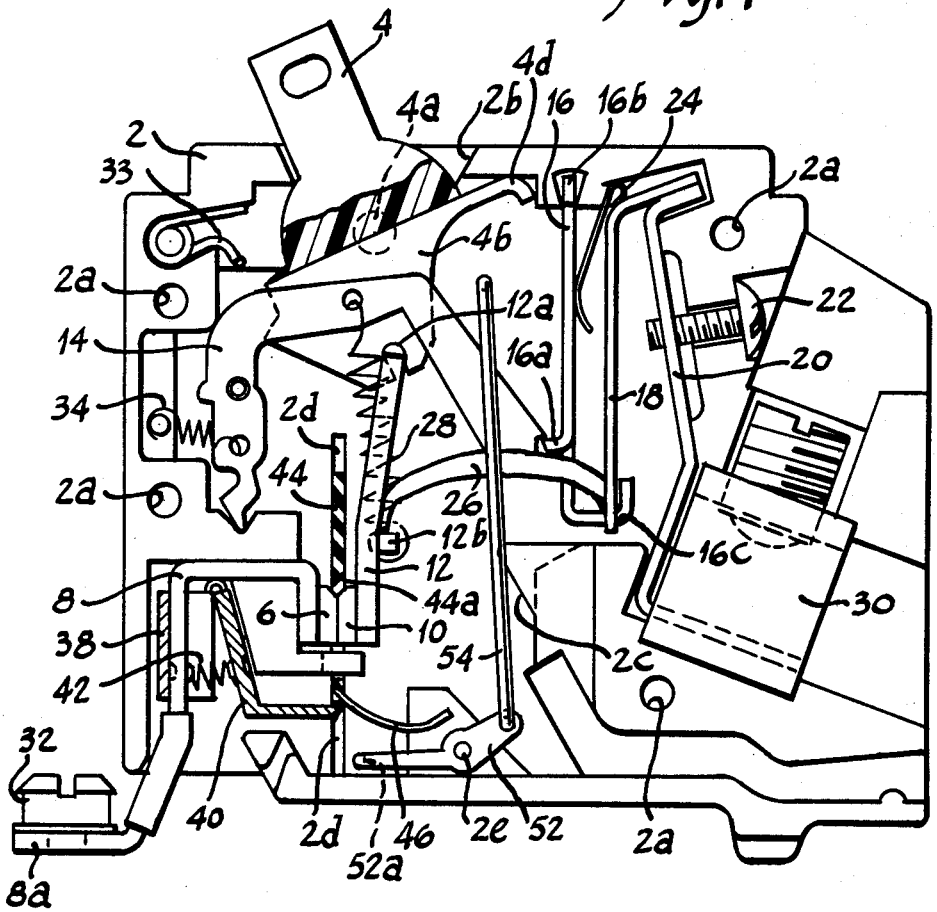
FIG. 1 is a side elevational view of the circuit breaker of this invention with a molded cover removed, showing the mechanism in the "ON" condition.

The drawings show a circuit breaker embodying this invention and comprising a molded insulating housing 2 which has a shallow cavity formed therein which is configured to receive and position the several parts comprising the circuit breaker. The parts are retained in position and within the housing 2 by a molded cover (not shown) which has a mating profile to that of the housing 2 and which is secured to the housing 2 by rivets (not shown) which extend through holes **2*a* in the housing and aligned holes in the cover. An opening 2*b* is formed in the forward or upper wall of housing 2 through which an operating handle 4 projects for manual operation of the circuit breaker. Handle 4 is pivotally mounted within the housing and cover by laterally projecting trunions 4*a*** (only one of which is shown) formed on the handle which are received in cylindrical recesses formed in the housing and cover to journal the handle for pivotal movement.

A stationary contact 6 is supported within the housing 2 by a combination stationary contact support and terminal member 8. A movable contact 10 is carried on the free end of a movable contact arm 12 which is pivotally hung from a lower portion of the operating handle 4. The handle 4 has a pair of spaced lateral flanges **4*b* (only one of which is shown in the drawings) and the movable contact arm 12 is essentially a flat U-shaped member having laterally projecting bearing pins or trunions 12*a* at its upper end for engagement in bearing slots formed in the respective flanges 4*b* of the handle 4**.

A U-shaped latch lever 14 is pivotally mounted in the housing 2 in an upside down or inverted manner. The free end of the left-hand leg of latch lever 14 engages a recess formed in the housing 2 to serve as the pivotal support for the latch lever. The bight portion of the latch lever extends between the flanges **4*b* of the operating handle 4 and the right-hand leg of the latch lever engages a catch 16*a* formed on a latch release member 16. The upper end of latch release member 16 is provided with a pair of laterally projecting ears 16*b* which are disposed within cooperating recesses in the housing and cover to pivotally mount the latch release member 16 for swinging movement within the cavity of the housing. The bottom end of the latch release member 16 is formed to provide an L-shaped hook 16***c*. A bimetal thermal sensing member 18 is mounted in the breaker housing 2 by a conducting strap 20. The bimetal and conducting strap are welded or brazed together at their upper ends and the conductor strap 20 is attached to the right-hand sidewall of the breaker housing 2 by a screw 22. Bimetal member 18 extends downwardly to have its free end disposed within the hook portion 16*c* of L-shaped latch release lever 16. A leaf spring 24 is trapped between an opening in the housing 2 and the bimetal member 18 and bears against the right-hand edge of latch release lever 16 to bias that member toward engagement with the right-hand leg of the latch lever 14. The free end of bimetal 18 is also electrically connected with the movable contact arm 12 by a flexible braided conductor 26.

The movable contact arm 12 and latch lever 14 are connected by a helical tension spring 28 which connects to the bight of latch lever 14 and to a projection 12*b* offset to the rear of movable contact arm 12. The spring 28 forms an over center toggle drive for the movable contact arm 12. Its end connection points are located so that movement of the operating handle 4 to the right as viewed in the drawings will carry the upper end of the movable contact arm 12 to the left-hand side of the center line of spring 28, thereby causing spring 28 to pivot the lower end of movable contact arm 12 to the right against a stop surface 2*c* in the housing 2. Reverse movement of the handle back to the left-hand position as shown in the drawings carries the upper end of movable contact arm 12 to the right-hand side of the center line of drive spring 28, thereby causing the latter to pivot the lower end of the movable contact arm to the left whereby contact 10 engages stationary contact 6.

A pressure connector 30 is attached to the end of conductor strap 20 to provide an "OFF" side terminal for the circuit breaker. A connecting device such as a bolt or slotted nut 32 is captively positioned over an opening in a flat extending terminal portion 8*a* of combined stationary contact support and terminal member 8 to provide an "ON" side terminal for the circuit breaker. In a typical installation of the circuit breaker to a panelboard, the terminal 8*a* rests upon a supply bus and is attached thereto by engagement of nut 32 with an upstanding threaded post of the supply bus. The connector 30 receives one or more wires which lead to the branch circuits to the protected by the circuit breaker. However, in some applications the breaker may serve as one of a plurality of breakers used as a multipole main service disconnect device, and when so used, the incoming supply wires are connected to the "OFF" side terminal 30 to feed electrical power to the panelboard through the "ON" side terminal 32 and 8*a*. When connected to an external power supply and a branch circuit or panelboard bus, a circuit may be seen to exist in the breaker from the terminal 8*a* through the stationary contact support and terminal member 8, stationary contact 6, movable contact 10, movable contact arm 12, flexible braided conductor 26, bimetal member 18 and conductive strap 20 to the connector 30. In the event of a prolonged low magnitude overload current condition in the protected circuit, the bimetal member 18 will become heated by this current and will warp to the right as viewed in the drawings. Such movement of bimetal member 18 causes it to engage hook porton 16*c* of latch release member 16 and carry it to the right, thereby unlatching the latch lever 14. When so unlatched, the latter pivots clockwise under the influence of drive spring 28 and such pivoting movement carries the line of action, or center line of the drive spring across the plane of movable contact arm 12 extending between the trunnions 12*a* and the projection 12*b* to the right-hand side of that plane, thereby causing spring 28 to toggle the movable contact arm 12 open against the stop portion 2*c* in the housing 2. The right-hand end of latch lever 14 also comes to rest against an upper surface of stop portion 2*c*.

When the breaker mechanism has been operated to the tripped position by the bimetal sensing member 18, the drive spring 28 and movable contact arm 12 have cooperated to move the handle 4 to an intermediate or nearly vertical tripped indicating position determined by engagement of handle 4 with torsion spring 33 positioned in the upper left-hand corner of housing 2. The working length of spring 28 and its force on the movable contact member 12 has been reduced considerably in this position. A helical tension spring 34 is attached to the left-hand leg of latch lever 14 and to a pin or other projection formed in the housing 2 to provide a counter-clockwise bias for the latch lever 14. The breaker operating mechanism is reset by moving the handle fully to the right-hand "OFF" position to further shorten the spring 28 and reduce the force therein whereby the tension spring 34 overcomes the horizontal component of spring 28 and causes the latch lever 14 to pivot counter-clockwise within the breaker, thereby carrying the right-hand end of latch lever 14 upward and into engagement with latch 16*a* of latch release member 16. Movement of the handle to the left-hand "ON" position causes the upper end of movable contact arm 12 to be carried across the center or operating line of drive spring 28 to cause the latter to drive the movable contact arm to the left whereby the contacts 10 and 6 are again in engagement.

A separate magnetic overload current sensing apparatus is provided in the breaker of this invention. A U-shaped pole piece 38 formed of a ferrous material is attached to the combined stationary contact support and terminal member 8 such that the free ends of the pole piece surround the member 8 and project toward the right in the drawings. An L-shaped armature 40 is pivotally supported within the housing 2 for movement into engagement across the free ends of the U-shaped pole piece member 38. A helical compression spring 42 is disposed between the member 8 and armature 40 to bias the armature 40 away from the pole piece 38 and to the right in the drawings. The right-hand end of L-shaped armature 40 extends into the path of a flat insulating member 44 which is mounted for linear sliding movement within the circuit breaker housing by guide slots 2*d* in the housing 2 and similar slots in the cooperating cover 4. The insulator 44 is provided with a window 44*a* having a beveled upper edge and through which contacts 6 and 10 extend for mutual engagement. A leaf or beam spring 46 is mounted within the housing 2 and engages the insulator 44 in an opening immediately below the window 44*a* to provide a downward bias for the insulator 44. Movement of the insulator 44 in the downward direction is prevented by the engagement of armature 40 with the lower edge of the insulator 44.

Figure 2:
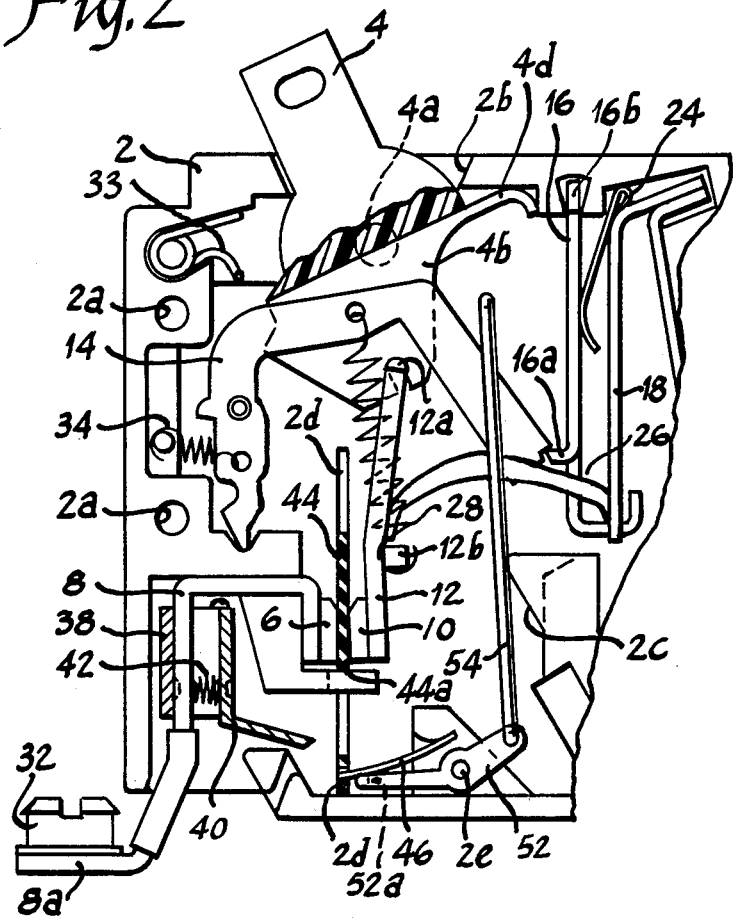
FIG. 2 is a view similar to FIG. 1 but showing the mechanism in an open circuit condition in response to actuation by a magnetic overcurrent sensing means.

Upon the occurrence of a high fault current condition within the breaker, the current in member 8 will generate an electromagnetic field in the U-shaped pole piece 38 and the armature 40 will be attracted thereto, thereby releasing the insulating member 44. Spring 46 subsequently operates to drive the insulating member 44 downward within the grooves such as **2*d* provided in the housing 2 and similar grooves in the housing 4. It can be seen that the upper edges of contacts 6 and 10 are beveled slightly to provide a divergent angle therebetween when in engagement, and the beveled upper edge of window 44*a* moves between the contacts to serve as a wedge to drive movable contact 10 and movable contact arm 12 to the right against the bias of drive spring 28 as shown in FIG. 2. As also shown in that figure, the upper edge of window 44*a* abuts against a surface 2*e* of insulating housing 2 which also extends through window 44*a* to effectively pinch off any arc that may have developed between the contacts 6 and 10 during separation thereof. While the magnetic sensing means operates very quickly in the presence of a high fault current condition to separate the contacts, a residual amount of this fault current is sensed by the bimetal member 18. This current causes the bimetal member to warp to the right to effect release of the latch lever 14 and movement of the operating mechanism to the tripped position as aforedescribed. Thus the movable contact arm 12 and latch lever 14 are positioned against the stop 2*c*** within the housing.

A resetting linkage is provided for returning insulator 44 to its original position when the breaker mechanism is reset as described hereinbefore. This linkage comprises a teeter bar 52 pivotally mounted on a pin **2*e* projecting from the interior sidewall of base 2 within the internal cavity. The left-hand end of teeter bar 52 has a rearwardly projecting pin 52*a* which is disposed below leaf spring 46 near the vertical plane of insulator 44. The other end of teeter bar 52 has an opening which receives the lower end of an elongated C-shaped push-rod link 54. While not specifically shown, link 54 may be guided for vertical reciprocal movement by formations in cover 4. The upper end of link 54 extends toward the interior sidewall of housing 2 to be disposed below operating handle 4. A projection 4*d* on the handle 4 is positioned to engage the upper end of link 54 when the handle is moved to the right-hand "OFF" position to initiate the resetting action of the breaker, thereby driving link 54 downward. This action causes teeter bar 52 to rotate clockwise whereby the pin 52*a* drives spring 46 and insulator 44 upward until the lower edge of insulator 44 clears the armature 40 to reset the insulator 44. Movement of handle 4** to the "ON" position resets the contact mechanism as aforedescribed.

While the circuit breaker disclosed herein represents a preferred form of the invention, it is to be understood that it is susceptible to various modifications without departing from the scope of the appendant claims.

I claim:

1. An electric circuit breaker comprising, in combination:

an insulating housing;

separable contacts disposed within said housing;

a movable contact arm pivoted at one end and carrying one of said separable contacts at its other end;

conductive support means positioning a second of said separable contacts in the path of travel of said one contact;

an operating mechanism for selectively causing said pivoted contact arm to move said one contact into and out of engagement with said second contact;

thermal means connected in circuit with said separable contacts for detecting overload currents of a first magnitude;

trip means operable in response to detection of said first magnitude overload currents by said thermal means for causing said pivoted contact arm to move said one contact out of engagement with said second contact;

magnetic means isolated from said thermal means for detecting overload currents of a second magnitude; and an insulating wedge disposed adjacent said second contact in a first position and operable in response to detection of said second magnitude overload currents by said magnetic means for movement between said separable contacts to a second position to cam said one contact away from said second contact, thereby to interrupt current flow between said contacts.

2. The invention defined in claim 1 wherein said magnetic means is associated with said conductive support means.

3. The invention defined in claim 2 wherein said thermal means is connected in circuit with said separable contacts at an opposite side of said separable contacts from said conductive support means.

4. The invention defined in claim 3 wherein electrical termination means are provided at opposite ends of said insulating housing, said thermal means having connection with one of said termination means at one end of said housing and said conductive support means having connections with another of said termination means at the opposite end of said housing.

5. The invention defined in claim 3 wherein said insulating wedge is a linearly slideable member releasably latched in said first position and biased for movement to said second position between said separable contacts.

6. The invention defined in claim 5 wherein insulating stop means are disposed in the path of said insulating wedge for engagement by said wedge upon movement thereof to said second position, said engagement severing an arc formed between said contacts during separation.

7. The invention defined in claim 6 wherein said magnetic means are operable to unlatch said insulating wedge.

8. The invention defined in claim 7 wherein said magnetic means comprises a magnetic pole piece fixed to said conductive support means and an armature mounted for attraction to said pole piece for unlatching said insulating wedge.

9. The invention defined in claim 6 wherein said operating mechanism is operable to reset said trip means subsequent to separation of said contacts as a result of operation of said trip means, and further comprising means cooperable with said operating mechanism for returning said insulating wedge to said first position upon resetting said trip means by said operating mechanism.

10. The invention defined in claim 9 wherein said insulating wedge is automatically latched in said first position when moved thereto from said second position.

11. An electric circuit breaker comprising, in combination:

an insulating housing;

a movable contact and a fixed contact disposed in said housing;

an operating mechanism for selectively moving said movable contact into and out of engagement with said fixed contact;

thermal means connected in circuit with said movable contact for detecting overload currents of a first magnitude;

trip means operable by said thermal means upon detection of said first magnitude overload currents for causing separation of said movable contact from said fixed contact;

magnetic means for detecting overload currents of a second magnitude comprising conductive means connected in circuit with said fixed contact and forming a portion of said magnetic means; and an insulating wedge releasably latched in a first position adjacent said fixed contact and biased for movement between said fixed and movable contacts to a second position whereby to cam said movable contact away from said fixed contact and interrupt current flow therebetween, said magnetic means being operable upon detection of said second magnitude overload currents to unlatch said insulating wedge.

* * * * *